US010909955B2

(12) United States Patent
Fortoloczki

(10) Patent No.: US 10,909,955 B2
(45) Date of Patent: Feb. 2, 2021

(54) METHODS AND ARTICLES FOR FACILITATING STRINGING OF A STRINGED INSTRUMENT HAVING MECHANICAL VIBRATO UNIT

(71) Applicant: Peter Fortoloczki, Essex Fells, NJ (US)

(72) Inventor: Peter Fortoloczki, Essex Fells, NJ (US)

( * ) Notice: Subject to any disclaimer, the term of this patent is extended or adjusted under 35 U.S.C. 154(b) by 0 days.

(21) Appl. No.: 16/471,402

(22) PCT Filed: Jan. 31, 2017

(86) PCT No.: PCT/US2017/067568
§ 371 (c)(1),
(2) Date: Jun. 19, 2019

(87) PCT Pub. No.: WO2018/119059
PCT Pub. Date: Jun. 28, 2018

(65) Prior Publication Data

US 2019/0371283 A1 Dec. 5, 2019

Related U.S. Application Data

(60) Provisional application No. 62/438,122, filed on Dec. 22, 2016.

(51) Int. Cl.

| | |
|---|---|
| ***G10D 1/12*** | (2006.01) |
| ***G10D 3/153*** | (2020.01) |
| ***G10D 1/08*** | (2006.01) |
| ***G10D 3/12*** | (2020.01) |

(52) U.S. Cl.
CPC ..... *G10D 3/153* (2020.02); *G10D 1/085* (2013.01); *G10D 3/12* (2013.01)

(58) Field of Classification Search
CPC ..... G10D 3/153; G10D 1/085; G10D 3/12
See application file for complete search history.

(56) References Cited

U.S. PATENT DOCUMENTS 2,949,806 A 8/1960 Turman
7,183,475 B2 2/2007 Van Halen
(Continued)

FOREIGN PATENT DOCUMENTS

GB 2509785 A 7/2014

OTHER PUBLICATIONS http://www.vibramate.com/vibramate-string-spoiler.php.
(Continued)

*Primary Examiner* — Kimberly R Lockett
(74) *Attorney, Agent, or Firm* — David B. Gomish; Eckert Seamans Cherin & Mellott, LLC

(57) ABSTRACT

Disclosed is a stringing device configured for facilitating stringing of a stringed instrument having a rotatable axle vibrato. The stringing device is an elongate article having an inner surface and an outer surface. The inner surface is configured for mating with an axle of a rotatable axle vibrato. The outer surface has a plurality of openings of corresponding string passages, where each string passage facilitates the passage of strings from the outer surface through the stringing device and extending out from the inner surface. The plurality of openings optionally each have an eyelet seat configured to retain an eyelet of a string. Methods of using the stringing device are also disclosed.

21 Claims, 11 Drawing Sheets

(56) References Cited

U.S. PATENT DOCUMENTS

| | | | | |
|---|---|---|---|---|
| 8,163,987 | B1 * | 4/2012 | Dennis | G10D 3/12 84/313 |
| 8,766,069 | B2 | 7/2014 | Bisheimer | |
| 9,230,525 | B2 | 1/2016 | Hunter et al. | |
| 2012/0285313 | A1 | 11/2012 | Bisheimer | |
| 2014/0202307 | A1 * | 7/2014 | Rose | G10D 3/153 84/313 |
| 2014/0230628 | A1 | 8/2014 | Hunter | |
| 2020/0043448 | A1 * | 2/2020 | Swope | G10D 3/153 |

OTHER PUBLICATIONS http://www.vibramate.com/images/instructions/Vibramate-SR1-Instructions.gif.
http://www.stringraytool.com/.
https://www.callahamguitars.com/bigsby_bridge_mainstringshaft_catalog.htm.

* cited by examiner

METHODS AND ARTICLES FOR FACILITATING STRINGING OF A STRINGED INSTRUMENT HAVING MECHANICAL VIBRATO UNIT

CROSS-REFERENCE TO RELATED APPLICATIONS

This application is a U.S. National Phase of International Application No. PCT/US2017/067568 filed Jan. 31, 2018, which claims priority to U.S. Provisional Patent Application No. 62/433,122 filed Dec. 22, 2016, which are incorporated herein by reference in their entirety.

BACKGROUND OF THE INVENTION

1. Field of Invention

This invention relates generally to methods and devices to facilitate stringing of stringed instruments having a mechanical vibrato unit. The invention more particularly relates to accessories for electric guitars having, e.g., "BIGSBY®" type vibratos, to facilitate applying and retaining new strings to such guitars for use.

2. Description of Related Art

Stringed instruments, for example, electric guitars, often include as a component, a device known alternatively as a "whammy bar," "vibrato" or "vibrato tailpiece." This mechanical device enables guitar players to manually bend the pitch of played notes or chords. A conventional vibrato allows a guitarist to strum or pluck strings and then actuate the vibrato effect by manually oscillating the tremolo arm or handle of the vibrato mechanism.

One very popular brand of guitar vibrato is the BIGSBY® vibrato tailpiece, which may come pre-installed on a guitar or may be separately purchased and then installed onto a guitar. A BIGSBY® vibrato tailpiece is a metallic assembly secured to the body of a guitar (typically, although not necessarily, an electric guitar).

The process of stringing a BIGSBY® vibrato can be difficult and unduly time consuming. Briefly, a typical BIGSBY® vibrato requires that for each string, a user pre-bend the eyelet end, secure the eyelet to an axle pin and wind the string around the axle with one hand while providing tension on the string with the other hand during winding and tuning around a tuning peg. In the act of stringing the vibrato, there is a tendency for the string at the eyelet end to attempt to resort back to its original pre-bent shape and not conform to the tight circumference of the axle. This can result in the eyelet slipping off the axle pin while a user is attempting to wind and tune the string, further complicating the stringing process. Accordingly, there is a need for a device and/or method to facilitate and streamline the process of stringing guitar vibrato mechanisms that have rotatable axles, e.g. BIGSBY® vibratos.

BRIEF SUMMARY OF THE INVENTION

In one aspect, a stringing device, configured for facilitating stringing of a stringed instrument having a rotatable axle vibrato, is provided. The stringing device includes an elongate article having an inner surface and an outer surface. At least a portion of the inner surface is configured for mating with an axle of a rotatable axle vibrato. The stringing device further includes a plurality of spaced-apart string passages, each string passage having an opening on the outer surface. The opening leads to a channel within the stringing device and the channel leads to an aperture disposed on the inner surface. Each string passage is configured for facilitating the passage of an instrument string from the outer surface, through the stringing device and exiting from the inner surface.

Optionally, in any embodiment of the stringing device, each opening includes an eyelet seat. Optionally, the eyelet seat includes an optionally bulbous depression about the opening in the outer surface, fully surrounding the entrance to the channel.

Optionally, in any embodiment of the stringing device, the inner surface has at least two contact surfaces configured to contact the axle along its length when the inner surface is mated to it. Each of the at least two contact surfaces have an extreme end, i.e., an end that is furthest from an end of the other contact surface. The extreme ends of the contact surfaces are optionally oriented at least 60° apart from each other relative to a central axis of the axle. In an alternate optional embodiment, the inner surface has a continuous contact surface that is curved and configured to contact the axle along its length and wrap around an arc of the axle. Optionally, the contact surface wraps around an arc length corresponding to an angle $\Theta$ of at least 60° about the central axis of the axle.

Optionally, in any embodiment of the stringing device, the inner surface and outer surface define a side profile of the entire elongate article that is substantially arcuate in shape. In such an embodiment, the stringing device does not include any structure(s) extending from the side profile or otherwise noticeably disrupting the substantially arcuate shape of the side profile.

Optionally, in any embodiment of the stringing device, the inner surface and the outer surface run lengthwise from a proximal end to a distal end of the elongate article. The inner surface has a portion configured for mating with an axle of a rotatable axle vibrato. The inner surface further includes a first elongate end and a second elongate end, wherein the portion configured for mating with an axle of a rotatable axle vibrato is disposed between the first elongate end and the second elongate end.

Optionally, in any embodiment of the stringing device, the stringing device is configured to facilitate wrapping of an instrument string around part of a circumference of an axle of a rotatable axle vibrato.

Optionally, in any embodiment of the stringing device, each opening includes an annular eyelet seat.

Optionally, in any embodiment of the stringing device, the stringing device is a single metal component.

Optionally, in any embodiment of the stringing device, at least a portion of the inner surface is arcuate and configured to wrap around an arc of an axle to which the stringing device is secured, optionally around at least an arc length corresponding to an angle $\Theta$ of 60° about the central axis of the axle.

Optionally, in any embodiment of the stringing device, the stringing device includes a plurality of linearly arranged mating bores along the inner surface. The bores extend radially through at least a portion of the stringing device. The mating bores are configured for mating with corresponding axle pins extending radially outward from an axle to secure the stringing device to the axle.

In an optional embodiment of the disclosed concept, an assembly is provided. The assembly includes a rotatable axle vibrato having a mount to which a rotatable axle configured for retaining strings of a stringed instrument is rotatably mounted. The assembly further includes a stringing device according to any embodiment disclosed herein secured about the axle such that the stringing device is rotationally fixed relative to the axle.

Optionally, in any embodiment of the assembly, the axle comprises a plurality of axle pins extending radially from the axle. The axle pins mate with corresponding linearly arranged mating bores along the inner surface of the stringing device, optionally in a press fit or snap fit relationship, to secure the stringing device to the axle.

Optionally, in any embodiment of the assembly, the inner surface is curved and configured to contact the axle along its length and wrap around an arc of the axle, optionally around at least an arc length corresponding to an angle $\Theta$ of 60° about the central axis of the axle.

Optionally, in any embodiment of the assembly, the assembly is mounted to a guitar body.

Optionally, in any embodiment of the assembly, a plurality of instrument strings are secured to the assembly at respective string eyelet ends and are wound at opposite ends to corresponding tuning pegs of a guitar. Optionally, in this configuration, the rotatable axle vibrato may be actuated to oscillate the strings between loosened and tightened states, i.e., while the instrument strings are secured to the stringing device.

Optionally, in any embodiment of the assembly, the assembly includes a plurality of instrument strings secured, at respective string eyelet ends, to the stringing device. At least one of the strings passes from the outer surface, through a respective string passage and exits from the inner surface, so as to wrap around part of a circumference of an axle of a rotatable axle vibrato. Optionally, in this configuration, the rotatable axle vibrato may be actuated to oscillate the strings between loosened and tightened states, i.e., while the instrument strings are secured to the stringing device.

In an optional embodiment of the disclosed concept, a method for making any embodiment of the assembly is provided. The method includes aligning the stringing device with the axle such that at least part of the inner surface faces the axle. The method further includes securing the stringing device about the axle such that the stringing device is rotationally fixed relative to the axle. In other words, the stringing device is immovable relative to the axle such that axle and stringing device are rotatable together as a unit.

Optionally, in a method for making any embodiment of the assembly, the method includes mating a plurality of axle pins extending radially from the axle with corresponding linearly arranged mating bores along the inner surface of the stringing device, optionally in a press fit or snap fit relationship.

In an optional embodiment of the disclosed concept, a method for stringing a stringed instrument having any embodiment of an assembly secured to a body of the instrument is provided. The method includes placing a top end of a string through an opening of a corresponding string passage, the opening having an eyelet seat configured for retaining an eyelet of the string. The method further includes displacing the string through the string passage, from the outer surface, through the stringing device and exiting from the inner surface, until an eyelet of the string is retained in the eyelet seat. In this manner, the string is wrapped about a portion of a circumference of the axle. The method further includes winding the top end of the string around a tuning peg (provided, e.g., on a headstock of the instrument) to manipulate string tension and provide a desired string pitch.

Optionally, in any embodiment of a method for stringing a stringed instrument having any embodiment of an assembly secured to the body of the instrument, the string does not need to be pre-bent or crimped before being displaced through the string passage and wrapped around the axle.

Optionally, in any embodiment of a method for stringing a stringed instrument having any embodiment of an assembly secured to the body of the instrument, displacing the instrument string through the string passage is done manually using a single hand holding the string without the need for another hand to hold the eyelet end of the string in place around the axle.

Optionally, in any embodiment of a method for stringing a stringed instrument having any embodiment of an assembly secured to the body of the instrument, the stringed instrument is an electric guitar.

Optionally, in any embodiment of the disclosed concept, the rotatable axle vibrato of any embodiment of the assembly may be used (played) by actuating the vibrato to oscillate the strings between loosened and tightened states. In this way, the stringing device remains fixed to the axle (as opposed to a tool that is used to apply strings and then removed from the vibrato) during normal use of the stringed instrument.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF PREFERRED EMBODIMENTS OF THE INVENTION

The present invention will now be described more fully with reference to the accompanying drawings, in which different embodiments are shown. This invention may, however, be embodied in many different forms and should not be construed as limited to the embodiments set forth here. Rather, these embodiments are examples of the invention, which has the full scope indicated by the language of the claims. Like numbers refer to like elements throughout.

Throughout this application, the phrase "stringing of a stringed instrument" may be used to generally describe the process of applying and securing strings to a stringed instrument (e.g., a guitar) so that the instrument may be tuned and played. Typically, stringing of a guitar involves securing one end of a respective string (e.g., an "eyelet end") to the guitar bridge or vibrato tailpiece and securing an opposite end of the string to a tuning peg that is normally mounted to a headstock. An appropriate amount of tension may be applied to the string (typically by manipulating the tuning peg) to achieve desired tuning of the string.

Figure 1:
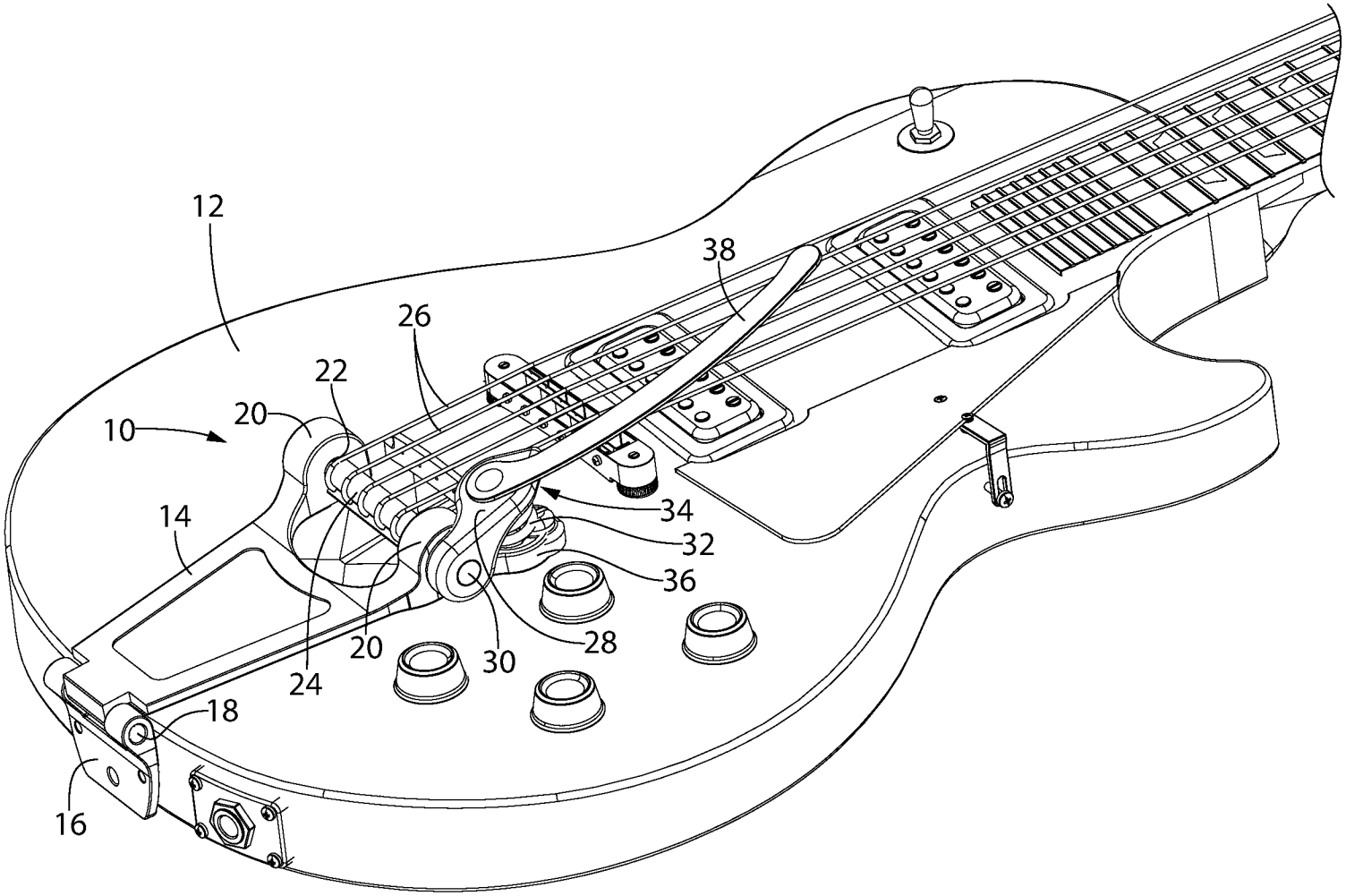
FIG. 1 is s perspective view of a representative BIGSBY®-type vibrato (exemplary rotatable axle vibrato) mounted to an electric guitar body.

By way of background, FIG. 1 shows a perspective view of a representative BIGSBY®-type vibrato 10 (also referred to herein as a "rotatable axle vibrato") mounted to an electric guitar body 12. The vibrato 10 is typically a metallic assembly that includes a mount 14 that is immovably secured to the front face of the guitar body 12. The assembly may also include a bottom plate 16 that is optionally pivotally coupled to the mount 14 by a hinge 18. When the vibrato 10 is installed onto a guitar, the plate 16 is configured to be aligned generally perpendicular to the mount 14 and to be fixedly secured to the bottom of the guitar body 12, e.g., with screws. Securing of the plate 16 to the guitar in this manner helps to ensure that the mount 14 is very firmly secured to the guitar, since a loosely secured vibrato may adversely affect tuning of the instrument and the quality of the desired tremolo effect.

The mount 14 includes opposing flanges 20 projecting outwardly from the front of the guitar body 12. The flanges include aligned bores 22 configured for rotatable mounting of an anchor bar or axle 24. The axle 24 is rotatable about its central axis and is configured to have guitar strings 26 secured to an end thereof (e.g., wherein each string end is secured to a small axle pin projecting radially from the axle, as discussed below). The strings 26 are wrapped substantially about the circumference of the axle 26 (e.g., about 300°) and extend tangentially over the axle 24, continuing in paths that extend over the bridge, the guitar neck and ultimately around the tuning pegs.

A bracket 28 may be coupled to an end 30 of the axle 24, the bracket 28 being configured, upon actuation (e.g., via motion towards and away from the guitar body 12), to slightly rotate the axle 24 about its axis (e.g., by a few degrees). Such rotation, when the strings 26 are fully strung and tuned on the guitar, operates to slightly oscillate the strings between loosened and tightened states. This results in the pitch bending or vibrato effect when the strings 26 are strummed or plucked in conjunction with actuation of the bracket 28. A compression spring element 32 is optionally provided between an underside 34 of the bracket 28 and an opposing spring retainer 36 of the mount 14. When the bracket 28 is not being actuated, the spring element 32 helps retain the vibrato 10 (and by extension, the strings 26) in a resting position, wherein the bracket 28 is positioned relative to the guitar body 12 at a pre-set distance and orientation. This resting position or natural state provides precise tensioning of the strings 26 that sets the tones of the strings 26 to their desired open tuning pitches (e.g., in standard open tuning—E, A, D, G, B, E). A tremolo bar or handle 38 may be secured to an end of the bracket 28. The handle 38 is the colloquially-termed "whammy bar" component that may be used by a guitar player to actuate the bracket 28 (and by extension the axle 24 and strings 26) while playing the guitar to achieve a vibrato effect.

Figure 2A:
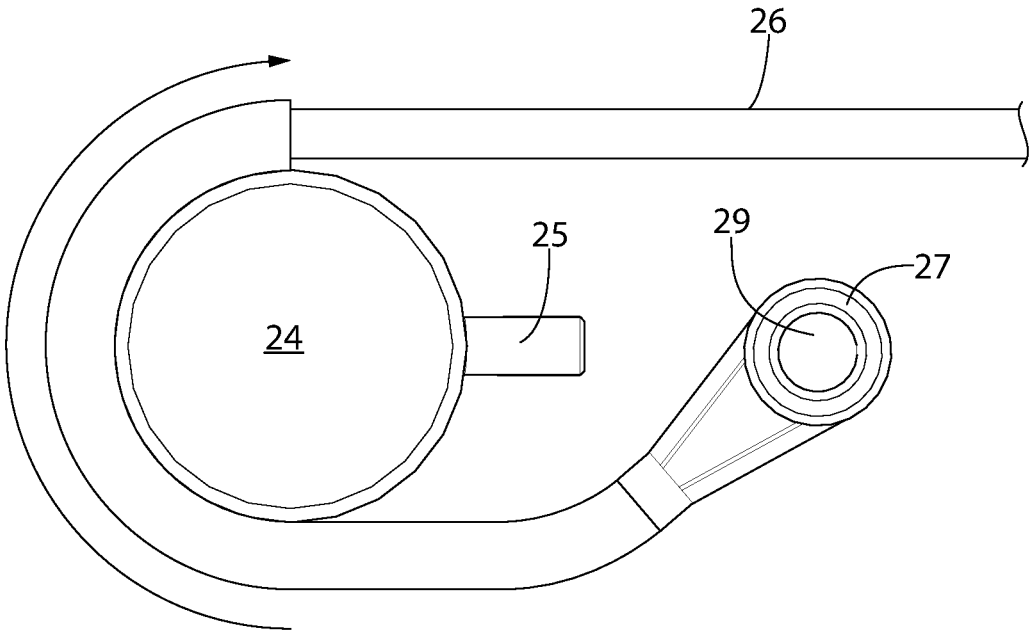
FIGS. 2A and 2B are schematic illustrations of how strings are applied to an axle of the representative BIGSBY®-type vibrato of FIG. 1.
Figure 2B:
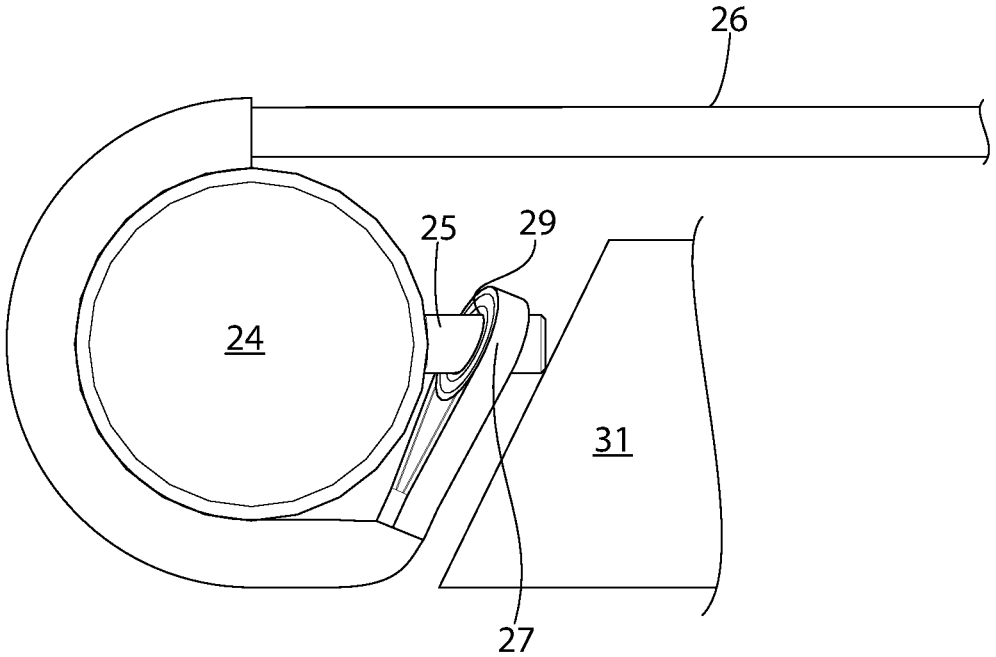

The BIGSBY®-type vibrato (and other structural equivalents having rotatable anchor bars/axles) is beloved by many guitarists. However, restringing the vibrato can be complicated and time consuming. This can be particularly troublesome if a string breaks and needs to be replaced during a performance. A schematic illustration of how the typical BIGSBY® vibrato is strung is provided in FIGS. 2A and 2B. These figures show isolated side views of the axle 24, with a guitar string 26 being applied thereto. The string 26 comprises a ball or eyelet 27 at an end thereof. The eyelet 27 is ring-like and comprises a central opening 29 that is configured to be secured over a small axle pin 25 projecting radially from the axle 24. To apply a string 26 to the axle 24, a user first crimps the string 26 near the eyelet end e.g., 45° and/or applies a pre-bend near the eyelet end using a round implement, e.g., a pen or pencil. Next, the user feeds the string underneath, around and over the axle (as shown in FIG. 2A). Next, the user secures the eyelet 27 over the axle pin 25 with one hand while maintaining tension on the string 26 with the other hand to hold the eyelet 27 in place. While winding the opposite end of the string 26 about a tuning peg to set and tune the string 26, it may be advantageous to place a wedge 31 (e.g., a foam wedge, as shown in FIG. 2B) into part of the space beneath the axle 24 and axle pin 25 to keep the string 26 in place while tuning it. This process is repeated for every string that is to be applied.

FIGS. 3 through 10B illustrate articles and methods according to optional embodiments of the invention, for stringing a BIGSBY®-type vibrato. While the BIGSBY® vibrato is a preferred brand, embodiments of the invention are not limited to use with that specific brand alone. More generally, embodiments of the invention may be usable with any vibrato that includes a rotatable anchor bar or axle, e.g., such as the axle 24 of FIG. 1. With this in mind, any vibrato (whether BIGSBY® brand or not) that operates with a rotatable axle around which the strings are wound and secured, is herein referred to as a "rotatable axle vibrato." A rotatable axle vibrato may or may not have all of the accoutrements of the representative vibrato 10 of FIG. 1; the key is that it operates with a rotatable axle, as just explained.

Figure 3:
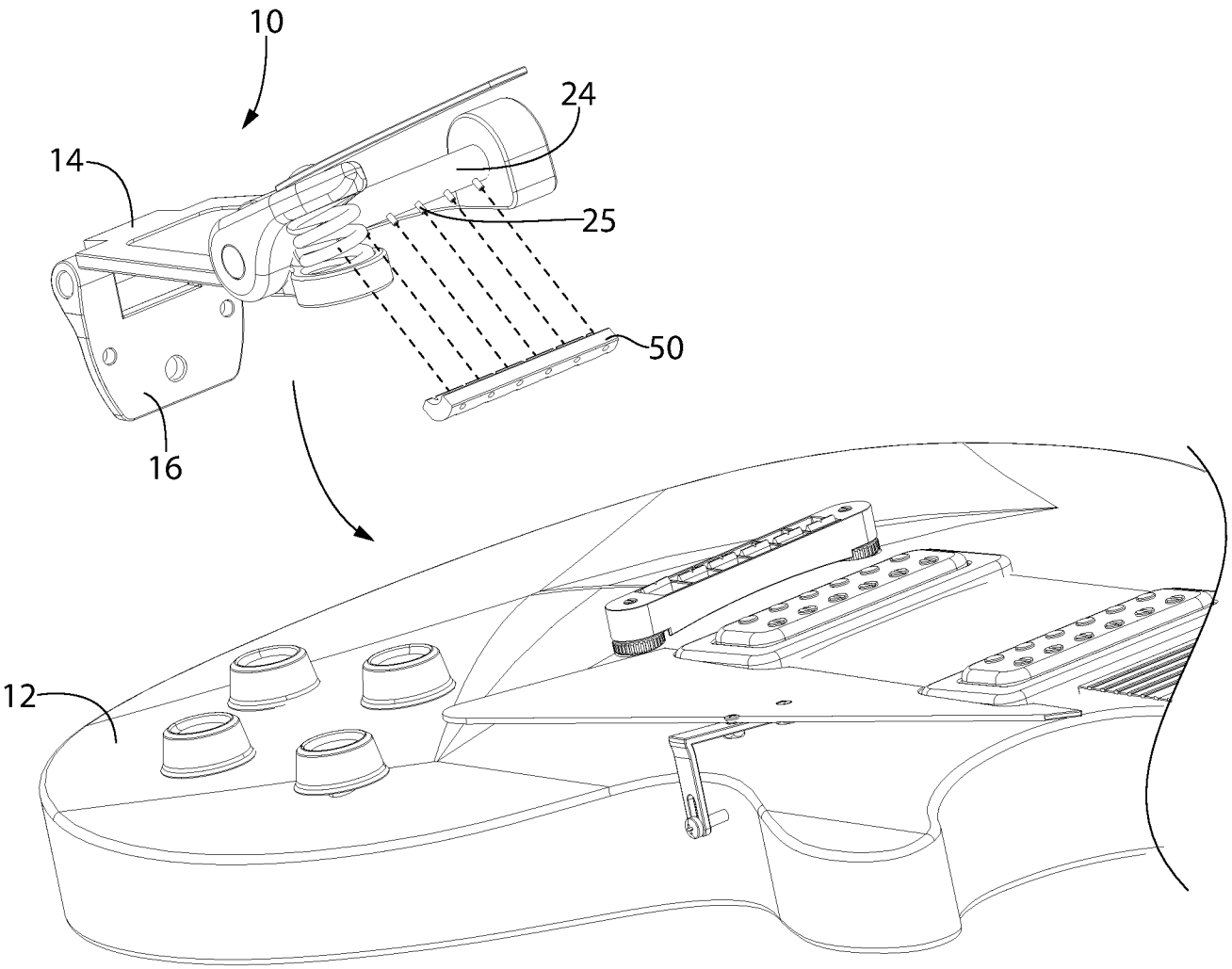
FIG. 3 is a perspective exploded view demonstrating how a stringing device according to an optional embodiment of the invention may be assembled to a rotatable axle vibrato.

FIG. 3 shows the representative vibrato 10 and a stringing device 50 according to an optional aspect of the disclosed concept, aligned with the axle 24. As shown, the device 50 is primed for being secured to the axle 24.

Figure 4:
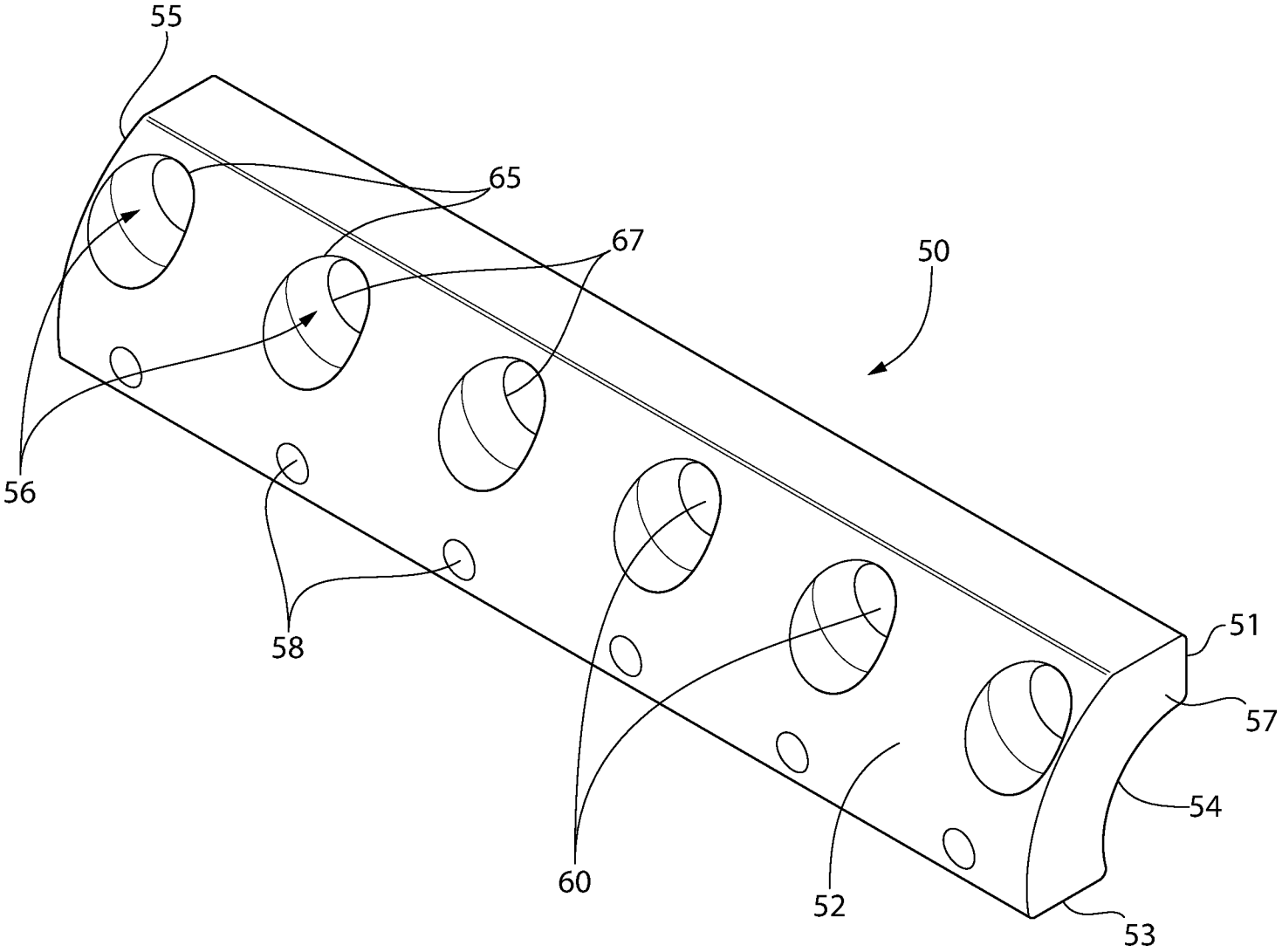
FIG. 4 is a perspective isolated view of the stringing device shown in FIG. 3, focusing on an outer surface of the same.
Figure 5:
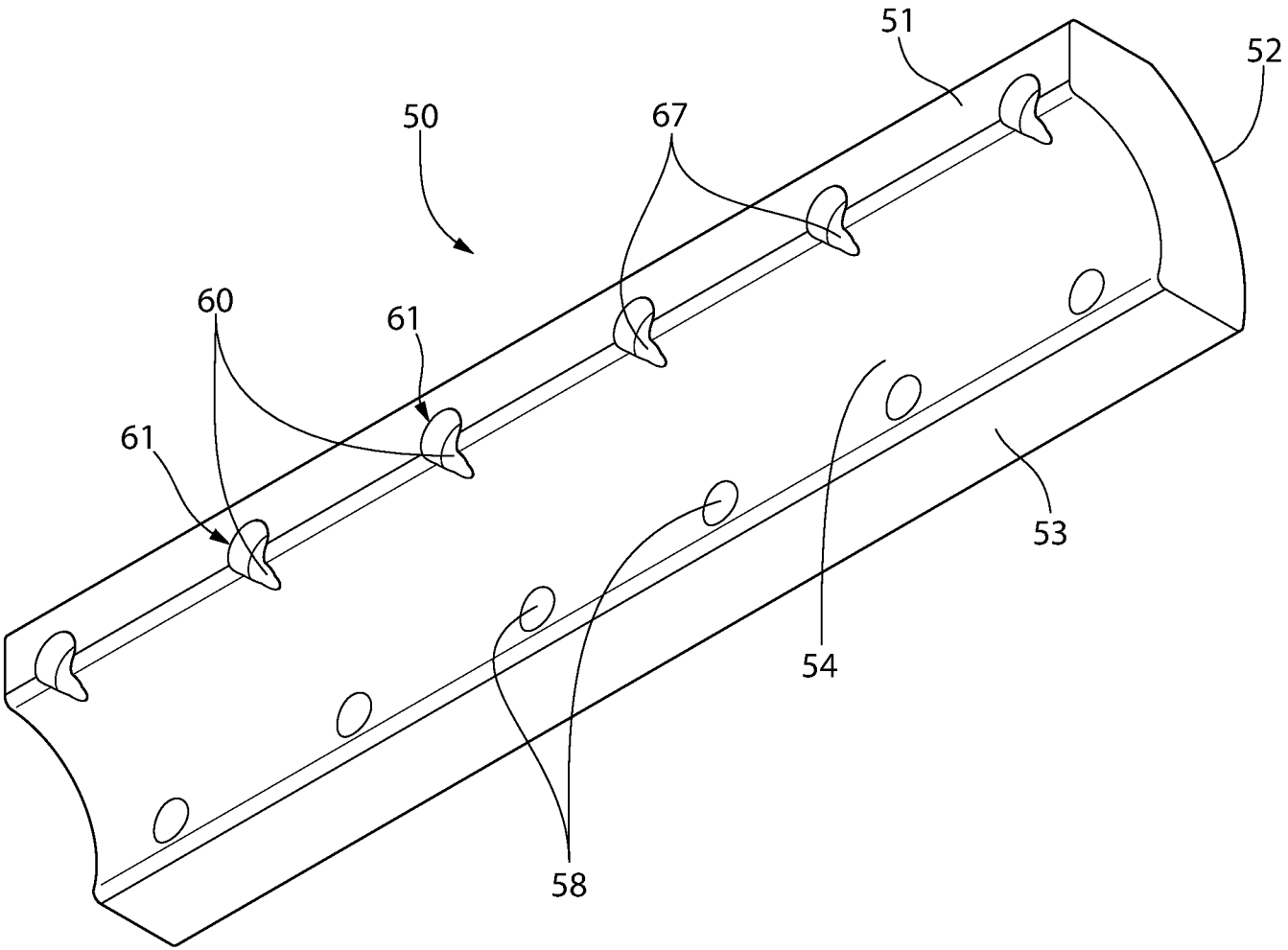
FIG. 5 is a different perspective view of the stringing device of FIG. 4, focusing on an inner surface of the same.

As shown in FIGS. 4 and 5, the stringing device 50 is preferably an elongate single piece component or article comprising an inner surface 54 and an outer surface 52. Both surfaces 52,54 preferably run the length of the stringing device 50 from a proximal end 55 to a distal end 57. The inner surface 54 includes a first elongate end 51 and second elongate end 53, each of which also preferably run the length of the stringing device 50 from the proximal end 55 to the distal end 57. The outer surface 52 extends from its border with the first elongate end 51 to its border with the second elongate end 53.

Figure 6:
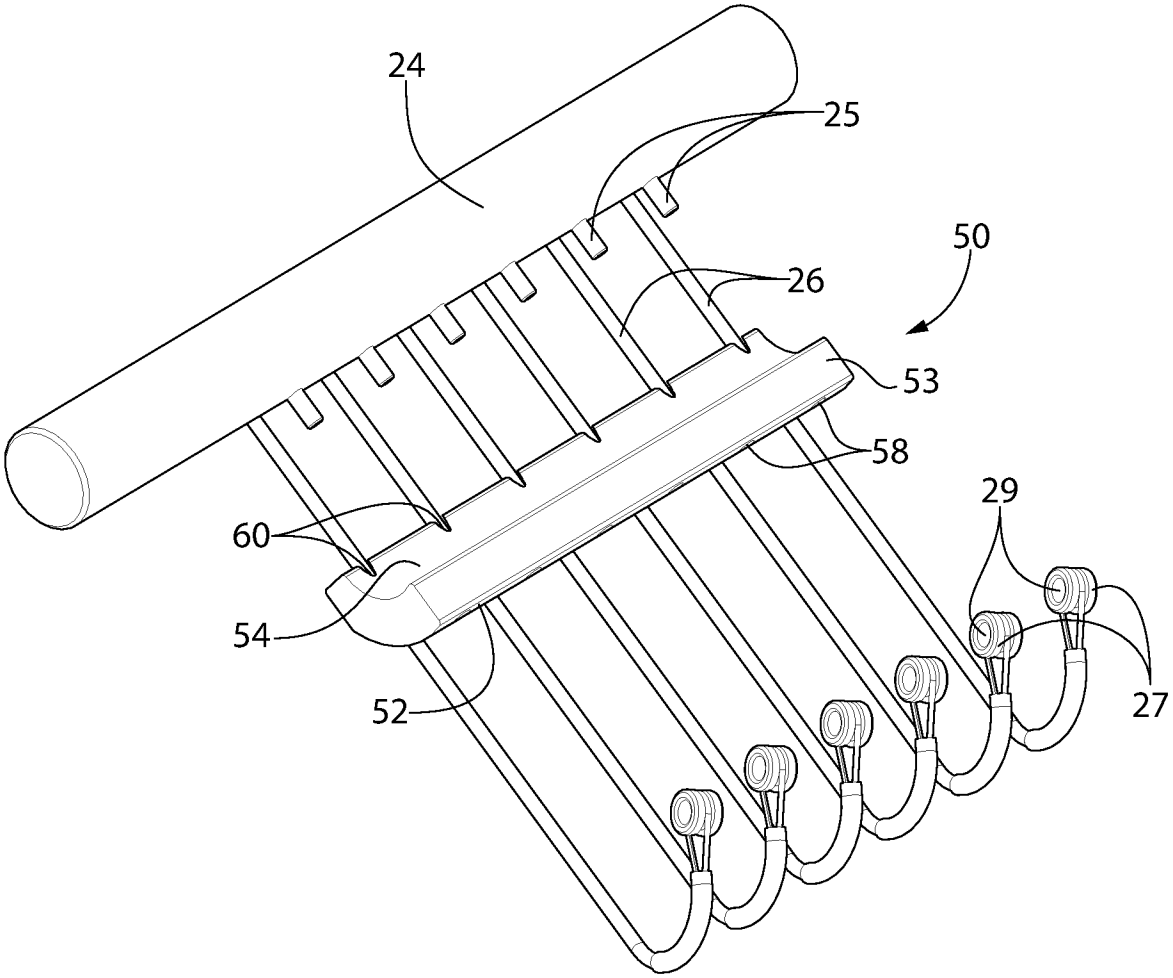
FIG. 6 is an isolated exploded perspective view showing instrument strings protruding through string passages from the outer surface and out the inner surface of the stringing device when the stringing device would be assembled to an axle of a rotatable axle vibrato.
Figure 10:
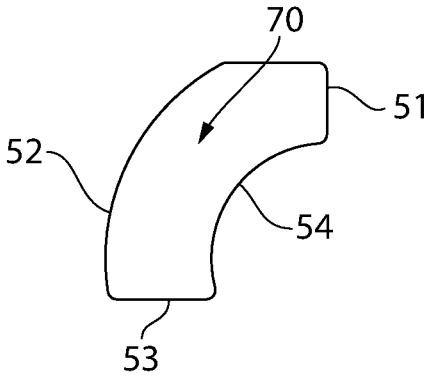
FIG. 10 is a side view of the stringing device of FIGS. 3-9.
Figure 10A:
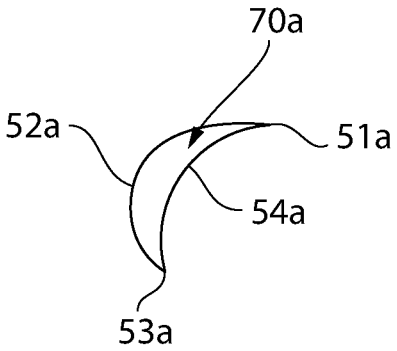
FIG. 10A is a side view of a first alternative embodiment of a stringing device.

Optionally, the first and/or second elongate ends 51,53 are substantially planar, e.g., as shown in FIGS. 4-6. Alternatively, as shown in FIG. 10A, one or both of the elongate ends 51*a*,53*a* may have sharp edges. In yet another alternative embodiment, shown in FIG. 10B, one or both of the elongate ends 51*b*,53*b* may be rounded. Regardless of specific geometry, the elongate ends 51,53, 51*a*,53*a*, 51*b*, 53*b*, respectively demarcate boundaries of the inner surface 54,54*a*,54*b* with the outer surface 52,52*a*,52*b*.

In an optional aspect, at least a portion of the inner surface 54 of the stringing device 50 is curved and configured for mating with an axle 24 of a rotatable axle vibrato, e.g., 10. FIG. 10 shows a side view of the stringing device 50 of FIGS. 3-9. This view shows a general curvature of a portion of the inner surface 54 and a portion of the outer surface 52. As shown, the inner surface 54 and outer surface 52 together define a side profile 70 of the entire device 50 that is substantially arcuate in shape. The inner surface 54*a* and outer surface 52*a* of the embodiment shown in FIG. 10A also defines a side profile 70*a* of the entire device that is substantially arcuate in shape. Also, the inner surface 54*b* and outer surface 52*b* of the embodiment shown in FIG. 10B defines a side profile 70*b* of the entire device that is substantially arcuate in shape. The side profile 70*a* of the embodiment of FIG. 10A is quarter-moon shaped while the side profile 70*b* of the embodiment of FIG. 10B is kidney-shaped (both are arcuate variations). As shown in the alternative embodiments shown in FIGS. 10, 10A and 10B, there is preferably no additional structure extending from or otherwise interrupting the respective substantially arcuate side profiles 70,70*a*,70*b* of the stringing devices. As such, the device is generally compact and sleek looking in appearance.

The stringing device 50 is optionally made from metal and preferably comprises a plurality of linearly arranged mating bores 58 along the inner surface 54. The mating bores 58 extend radially through the device 50, optionally to openings on the outer surface 52. The stringing device 50 further comprises a plurality of spaced-apart string passages 60. The string passages 60 are configured for facilitating the passage of strings from the outer surface 52, through the device 50, and extending out from the inner surface 54. Each string passage 60 includes an opening 65 on the outer surface 52, the opening 65 leading to a channel 67, the channel 67 leading to an aperture 61 disposed on the inner surface 54.

Optionally, the opening 65 includes an eyelet seat 56, which comprises an optionally bulbous depression about the opening 65 in the outer surface 52, fully surrounding the entrance to the channel 67. The eyelet seat 56 is configured to retain the eyelet 27 of each respective string, as discussed below. In the exemplary device 50 shown, there are six string passages 60, which are each respectively configured for pass-through of a string of a standard six-string guitar. However, it is contemplated that stringing devices according to optional embodiments may have fewer or additional passages to accommodate instruments having fewer or greater than six strings.

Figure 7:
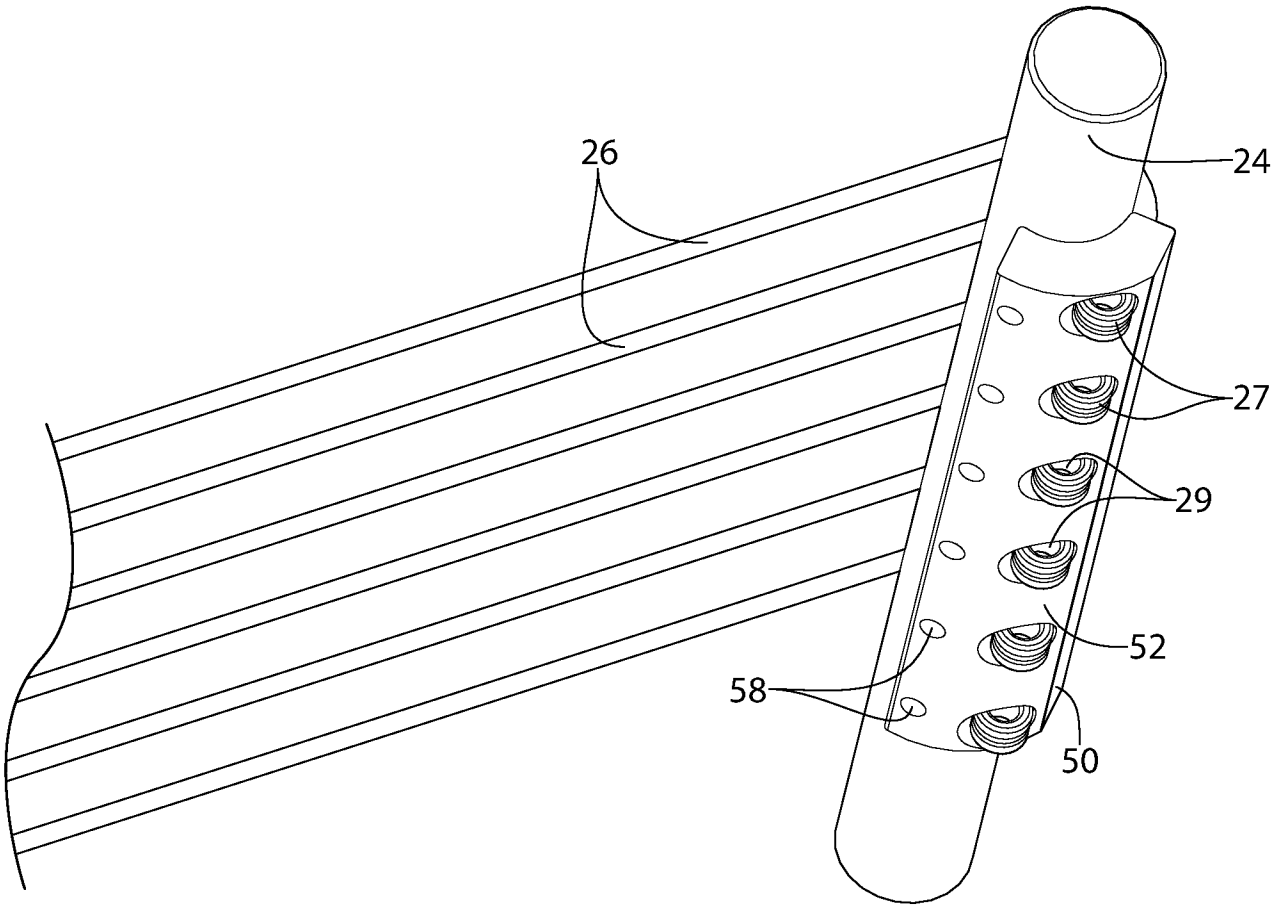
FIG. 7 is an isolated perspective view showing the stringing device of FIGS. 3-6 assembled to the axle with the strings secured thereto.

FIGS. 6 and 7 are isolated views of the stringing device 50 being assembled to an axle 24 of a rotatable axle vibrato 10, with strings 26 being secured to the device 50. FIG. 6 shows the stringing device 50 not yet secured to the axle 24 in order to better illustrate the operative components; it should be understood however, that the strings 26 would preferably not be secured to the device 50 until after the device 50 is mated with the axle 24. The stringing device 50 is optionally configured to be secured to the axle 24 as follows. The mating bores 58 on the inner surface 54 of the stringing device 50 are aligned with the six axle pins 25 extending radially from the axle 24. Next, a user presses the device 50 snugly against the axle 24 such that each axle pin 25 protrudes into a respective mating bore 58 of the device 50. Optionally, a press-fit relationship or snap-fit relationship exists between each mating bore 58 and corresponding axle pin 25 so as to help secure the stringing device 50 onto the axle 24. In this way, the device 50 is set into place and does not rotate relative to the axle 24 (i.e., the device 50 is rotationally fixed relative to the axle 24). Accordingly, the device 50 rotates with the axle 24 as a combined unit.

While it is possible that a user may desire to remove the device 50 each time strings are changed, it is contemplated that the user may leave the device 50 on the axle 24 permanently or over numerous cycles of removing and replacing strings. Optionally, the device 50 is a permanent fixture of the axle 24 that is applied during manufacturing. Alternatively, according to a preferred embodiment, the device 50 is an accessory that a user may obtain separately and apply to the vibrato 10. Regardless, in any embodiment, the device 50 remains secured to the axle 24 while the strings are on the instrument.

Figure 8:
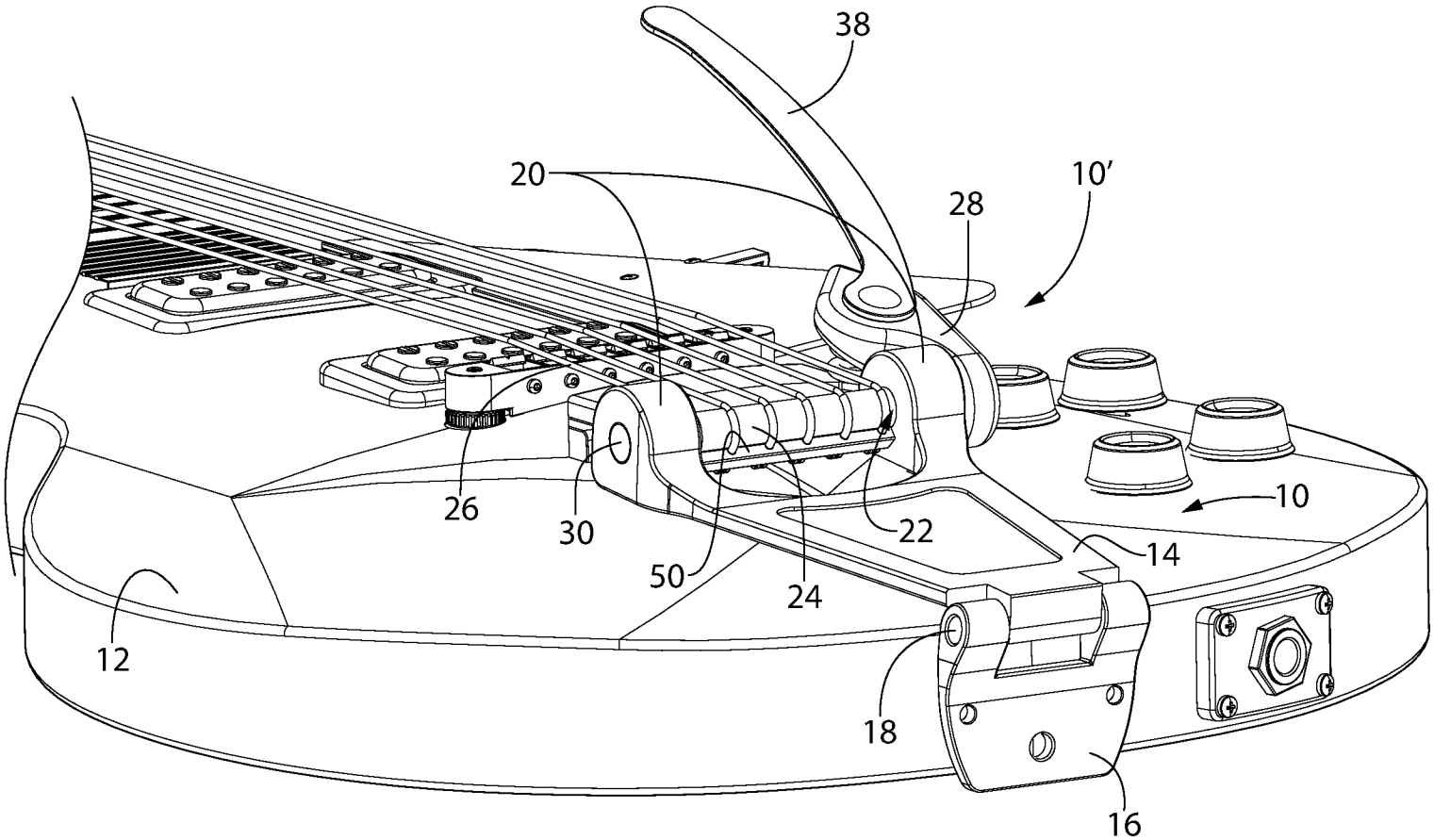
FIG. 8 is a perspective view of a guitar body with the rotatable axle vibrato and exemplary stringing device assembled thereto with strings secured around the axle and stringing device.
Figure 9:
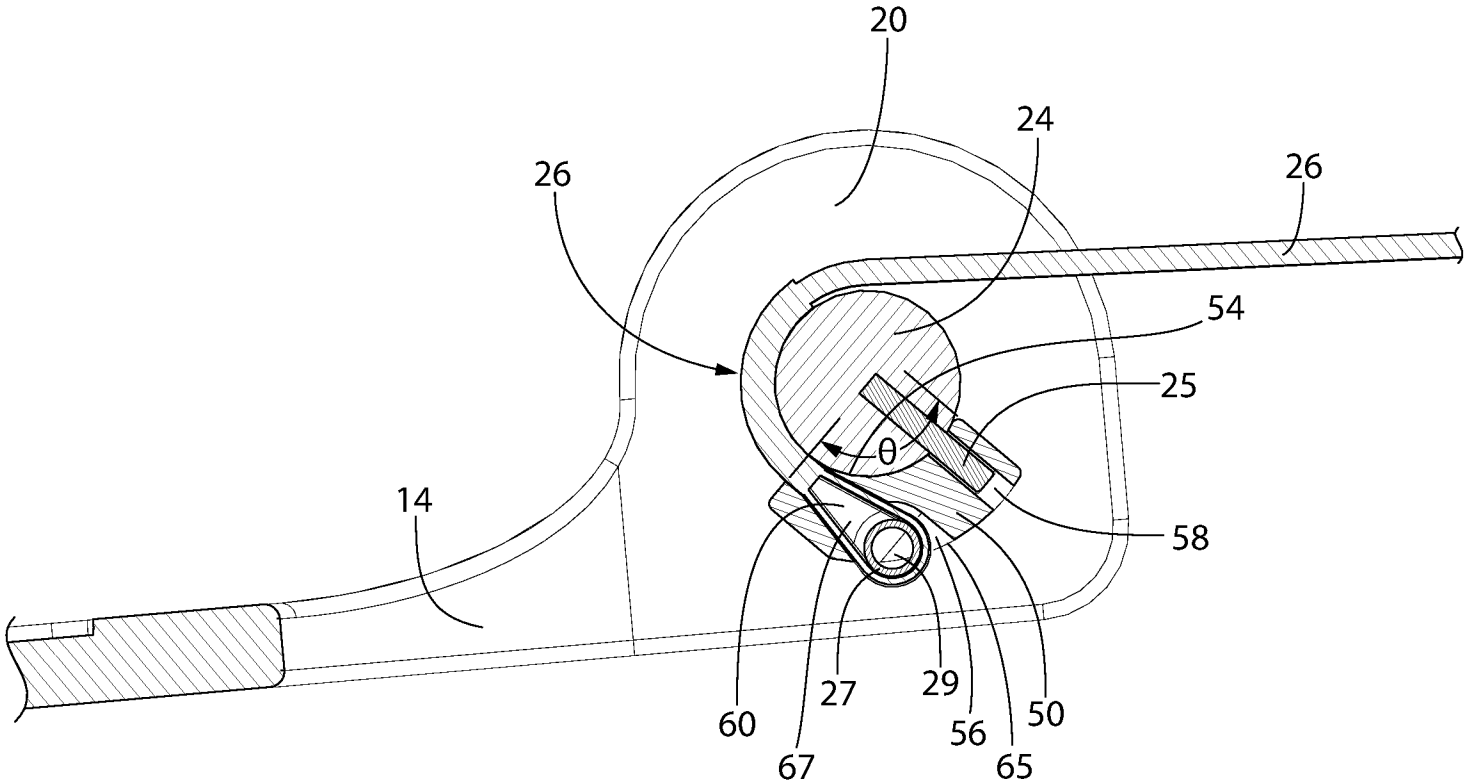
FIG. 9 is a cross-sectional isolated view of the vibrato mount of FIG. 8 showing how a guitar string is secured to the stringing device of FIGS. 3-8 and wraps around a part of the circumference the axle.
Figure 10B:
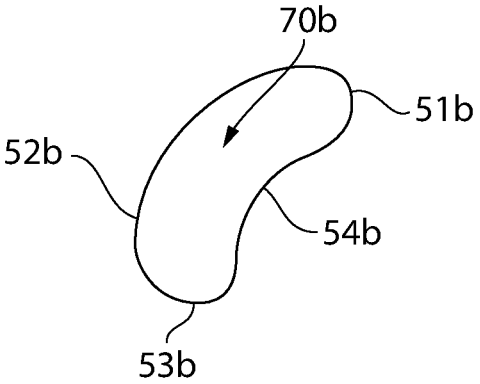
FIG. 10B is a side view of a second alternative embodiment of a stringing device.

FIGS. 7-9 show the stringing device 50 secured onto the axle 24, with the strings 26 strung onto the axle 24—stringing device 50 combination or unit. As shown in this view, the inner surface 54 of the device 50 preferably has a radius or curvature that corresponds to the outer radius or curvature of the axle 24, so that the device 50 may snugly fit onto the axle 24. The strings 26 are passed through the string passages 60 and each eyelet 27 is disposed on and retained by a respective eyelet seat 56. In this way, the eyelet ends of the strings 26 are tightly secured to the axle 24—stringing device 50 combination/unit and the strings 26 are wrapped tightly around part of the circumference of the axle (see FIG. 9). This enables the vibrato 10 to be thereafter used during playing of the instrument, in the manner described above. Notably, with this design, the string eyelet 27 is effectively secured (via the device 50) to the axle 24 so that the string remains on a tangential wrap on the axle 24. As such, the movement of the string when the vibrato is used is still exactly as per the intent of the original BIGSBY® design. This is important, since a design that would not wrap the string around part of the circumference of the axle may disrupt the dynamics of increasing/decreasing string tension, thus throwing off the string tuning.

Figure 9A:
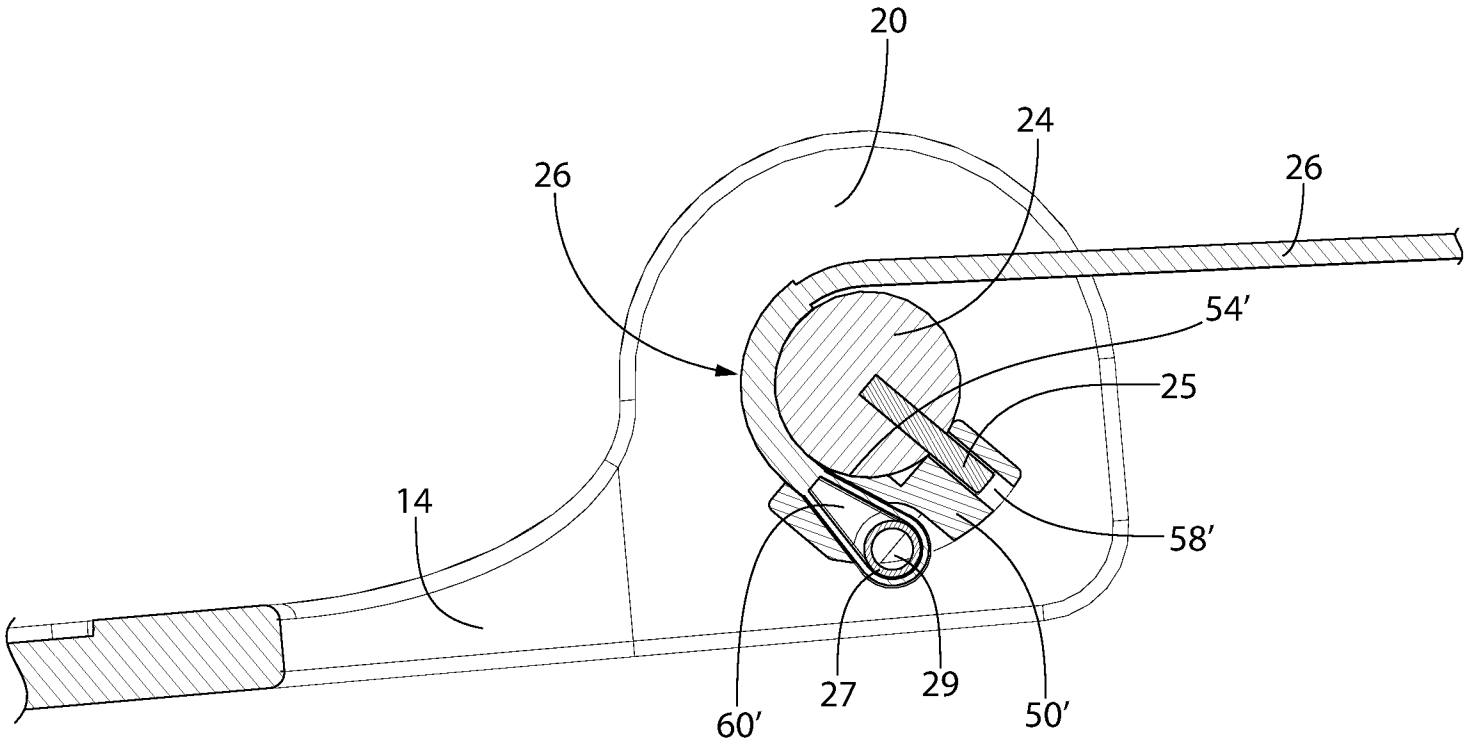
FIG. 9A is a cross-sectional isolated view of the vibrato mount of FIG. 8 showing how a guitar string is secured to and winds around the axle and exemplary stringing device having an alternative side profile from the stringing device of FIGS. 3-9.

Still referring to FIG. 9, the inner surface 54 of the stringing device 50 preferably includes a continuous contact surface that is curved and configured to contact the axle 24 along a length thereof and wrap around an arc thereof. Optionally, the continuous contact surface wraps around an arc length corresponding to an angle $\Theta$ of at least 60° about the central axis of the axle 24. However, alternative configurations may be provided consistent with the scope of the disclosed concept. For example, as shown in FIG. 9A, a slightly alternative configuration for a device 50' is shown. In that configuration, the inner surface 54' does not include a single continuous curved contact surface. Rather, the device 50' includes two contact surfaces separated by a gap in-between. The two contact surfaces (there could optionally be more than two) are configured to contact the axle 24 along a length thereof when the inner surface 54' is mated thereto. The contact surfaces are optionally oriented at least 60° apart from each other (from their respective extreme ends) relative to a central axis of the axle 24.

Stringing of a rotatable axle vibrato having the stringing device 50 secured thereto (hereinafter the combination of a vibrato 10 and device 50 is designated as 10', as identified in FIG. 8) may be done as follows. A user places the top end of each string 26 into the eyelet seat 56 end of a corresponding string passage 60. The user then pulls the string 26 through the passage 60 until the eyelet 27 is securely retained in the eyelet seat 56. The user applies tension to the string 26 and disposes the opposite end of the string 26 around/through a respective tuning peg of the instrument (e.g., on the headstock) to wind/tune the string to the desired pitch. As an optional advantage, the stringing device 50 enables a user to string an instrument having a rotatable axle vibrato, e.g., 10', without applying a pre-bend or crimp adjacent to the eyelet 27. This is because the string 26 will naturally and automatically bend tightly around the axle 24 during the stringing process. As another optional advantage, the user does not need to manually hold the eyelet 27 onto the axle pin 25 to retain the eyelet 27 thereon during stringing. This stands in contrast with traditional methods for stringing a typical rotatable axle vibrato without the benefit of an embodiment of the invention.

While the invention has been described in detail and with reference to specific examples thereof, it will be apparent to one skilled in the art that various changes and modifications can be made therein without departing from the spirit and scope thereof.

What is claimed is:

1. A stringing device configured for facilitating stringing of a stringed instrument that has a rotatable axle vibrato, the stringing device comprising:

a. an elongate article having an inner surface and an outer surface, at least a portion of the inner surface being configured for mating with an axle of a rotatable axle vibrato; and b. a plurality of spaced-apart string passages, each string passage comprising an opening on the outer surface, the opening leading to a channel within the stringing device, the channel leading to an aperture disposed on the inner surface, each string passage being configured for facilitating the passage of an instrument string from the outer surface, through the stringing device and exiting from the inner surface, wherein each opening includes an eyelet seat, which comprises a depression about the opening in the outer surface, fully surrounding the entrance to the channel.

2. A stringing device configured for facilitating stringing of a stringed instrument that has a rotatable axle vibrato, the stringing device comprising:

a. an elongate article having an inner surface and an outer surface, at least a portion of the inner surface being configured for mating with an axle of a rotatable axle vibrato, the axle comprising a central axis and an arc, the inner surface comprising:

i. at least two contact surfaces configured to contact the axle along a length thereof when the inner surface is mated thereto, the contact surfaces being oriented at least 60° apart from each other relative to the central axis of the axle; or ii. a continuous contact surface that is curved and configured to contact the axle along a length thereof and wrap around an arc length of the arc thereof, the arc length corresponding to an angle θ of at least 60° about the central axis of the axle; and b. a plurality of spaced-apart string passages, each string passage comprising an opening on the outer surface, the opening leading to a channel within the stringing device, the channel leading to an aperture disposed on the inner surface, each string passage being configured for facilitating the passage of an instrument string from the outer surface, through the stringing device and exiting from the inner surface wherein each opening includes an eyelet seat, which comprises a depression about the opening in the outer surface, fully surrounding the entrance to the channel.

3. A stringing device configured for facilitating stringing of a stringed instrument that has a rotatable axle vibrato, the stringing device comprising:

a. an elongate article having an inner surface and an outer surface, at least a portion of the inner surface being configured for mating with an axle of a rotatable axle vibrato, the inner surface and outer surface defining a side profile of the entire elongate article, the side profile in its entirety being substantially arcuate in shape such that there is no additional structure extending from or otherwise interrupting the substantially arcuate side profile; and b. a plurality of spaced-apart string passages, each string passage comprising an opening on the outer surface, the opening leading to a channel within the stringing device, the channel leading to an aperture disposed on the inner surface, each string passage being configured for facilitating the passage of an instrument string from the outer surface, through the stringing device and exiting from the inner surface.

4. The stringing device of claim 1, wherein the stringing device is configured to facilitate wrapping of the string around part of a circumference of an axle of a rotatable axle vibrato.

5. The stringing device of claim 1, wherein at least a portion of the inner surface is arcuate and configured to wrap around an arc length of an arc of an axle to which the stringing device is secured, the arc length corresponding to an angle θ of 60° about a central axis of the axle.

6. The stringing device of claim 1, further comprising a plurality of linearly arranged mating bores along the inner surface, the bores extending radially through at least a portion of the stringing device, the mating bores being configured for mating with corresponding axle pins extending radially outward from an axle to secure the stringing device to the axle.

7. An assembly, comprising:

a. a rotatable axle vibrato having a mount to which a rotatable axle configured for retaining strings of a stringed instrument is rotatably mounted; and b. the stringing device of claim 1 secured about the axle such that the stringing device is rotationally fixed relative to the axle.

8. The assembly of claim 7, wherein the axle comprises a plurality of axle pins extending radially from the axle, the axle pins mating with corresponding linearly arranged mating bores along the inner surface of the stringing device in a press fit or snap fit relationship, to secure the stringing device to the axle.

9. The assembly of claim 7, wherein the assembly is mounted to a guitar body and a plurality of instrument strings are secured to the assembly at respective string eyelet ends and are wound at opposite ends to corresponding tuning pegs of a guitar that comprises the guitar body, wherein each of the strings passes from the outer surface, through a respective string passage and exits from the inner surface, so as to wrap around part of a circumference of an axle of a rotatable axle vibrato.

10. A method for stringing a stringed instrument having the assembly of claim 7 secured to a body of the instrument, the method comprising:

a. placing a top end of an instrument string through an opening of a corresponding string passage;

b. displacing the instrument string through the string passage, from the outer surface, through the stringing device and exiting from the inner surface, until an eyelet of the instrument string is retained in the eyelet seat, wherein the instrument string is wrapped about a portion of a circumference of the axle; and c. winding the top end of the instrument string around a tuning peg provided on a headstock of the instrument to manipulate string tension and provide a desired string pitch.

11. The method of claim 10, wherein the instrument string does not need to be pre-bent or crimped before being displaced through the string passage and wrapped around the axle.

12. The method of claim 10 wherein steps (a) and (b) are performed manually using a single hand holding the instrument string.

13. An assembly, comprising:

a. a rotatable axle vibrato having a mount to which a rotatable axle configured for retaining strings of a guitar is rotatably mounted; and b. a stringing device configured for facilitating stringing of the guitar, the stringing device being secured about the axle such that the stringing device is rotationally fixed relative to the axle, the stringing device comprising:

i. an elongate article having an inner surface and an outer surface, at least a portion of the inner surface being configured for mating with an axle of a rotatable axle vibrato, the axle comprising a central axis and an arc, the inner surface comprising:

at least two contact surfaces configured to contact the axle along a length thereof when the inner surface is mated thereto, the contact surfaces being oriented at least 60° apart from each other relative to the central axis of the axle; or a continuous contact surface that is curved and configured to contact the axle along a length thereof and wrap around an arc length of the arc thereof, the arc length corresponding to an angle θ of at least 60° about the central axis of the axle; and ii. a plurality of spaced-apart string passages, each string passage comprising an opening on the outer surface, the opening leading to a channel within the stringing device, the channel leading to an aperture disposed on the inner surface, each string passage being configured for facilitating the passage of an instrument string from the outer surface, through the stringing device and exiting from the inner surface;

wherein the assembly is mounted to a guitar body of the guitar and a plurality of instrument strings are secured to the assembly at respective string eyelet ends and are wound at opposite ends to corresponding tuning pegs of the guitar, wherein each of the strings passes from the outer surface, through a respective string passage and exits from the inner surface, so as to wrap around part of a circumference of the axle.

14. The assembly of claim 13, wherein the axle comprises a plurality of axle pins extending radially from the axle, the axle pins mating with corresponding linearly arranged mating bores along the inner surface of the stringing device in a press fit or snap fit relationship, to secure the stringing device to the axle.

15. A method for stringing a stringed instrument having an assembly secured to a body of the instrument, the assembly comprising a rotatable axle vibrato having a mount to which a rotatable axle configured for retaining strings of a stringed instrument is rotatably mounted and a stringing device configured for facilitating stringing of the stringed instrument, the stringing device being secured about the axle such that the stringing device is rotationally fixed relative to the axle, the stringing device comprising:

i. an elongate article having an inner surface and an outer surface, at least a portion of the inner surface being configured for mating with an axle of a rotatable axle vibrato, the axle comprising a central axis and an arc, the inner surface comprising:

at least two contact surfaces configured to contact the axle along a length thereof when the inner surface is mated thereto, the contact surfaces being oriented at least 60° apart from each other relative to the central axis of the axle; or a continuous contact surface that is curved and configured to contact the axle along a length thereof and wrap around an arc length of the arc thereof, the arc length corresponding to an angle θ of at least 60° about the central axis of the axle; and ii. a plurality of spaced-apart string passages, each string passage comprising an opening on the outer surface, the opening leading to a channel within the stringing device, the channel leading to an aperture disposed on the inner surface, each string passage being configured for facilitating the passage of an instrument string from the outer surface, through the stringing device and exiting from the inner surface, the method comprising:

a. placing a top end of an instrument string through an opening of a corresponding string passage, the opening comprising an eyelet seat configured for retaining an eyelet of the instrument string;

b. displacing the instrument string through the string passage, from the outer surface, through the stringing device and exiting from the inner surface, until an eyelet of the instrument string is retained in the eyelet seat, wherein the instrument string is wrapped about a portion of a circumference of the axle; and c. winding the top end of the instrument string around a tuning peg provided on a headstock of the instrument to manipulate string tension and provide a desired string pitch.

16. An assembly, comprising:

a. a rotatable axle vibrato having a mount to which a rotatable axle configured for retaining strings of a stringed instrument is rotatably mounted; and b. the stringing device of claim 3 secured about the axle such that the stringing device is rotationally fixed relative to the axle.

17. The assembly of claim 16, wherein the axle comprises a plurality of axle pins extending radially from the axle, the axle pins mating with corresponding linearly arranged mating bores along the inner surface of the stringing device in a press fit or snap fit relationship, to secure the stringing device to the axle.

18. The assembly of claim 16, wherein the assembly is mounted to a guitar body and a plurality of instrument strings are secured to the assembly at respective string eyelet ends and are wound at opposite ends to corresponding tuning pegs of a guitar that comprises the guitar body, wherein each of the strings passes from the outer surface, through a respective string passage and exits from the inner surface, so as to wrap around part of a circumference of an axle of a rotatable axle vibrato.

19. A method for stringing a stringed instrument having the assembly of claim 16 secured to a body of the instrument, the method comprising:

a. placing a top end of an instrument string through an opening of a corresponding string passage, the opening comprising an eyelet seat configured for retaining an eyelet of the instrument string;

b. displacing the instrument string through the string passage, from the outer surface, through the stringing device and exiting from the inner surface, until an eyelet of the instrument string is retained in the eyelet seat, wherein the instrument string is wrapped about a portion of a circumference of the axle; and c. winding the top end of the instrument string around a tuning peg provided on a headstock of the instrument to manipulate string tension and provide a desired string pitch.

20. A method for stringing a stringed instrument having an assembly secured to a body of the instrument, the assembly comprising a rotatable axle vibrato having a mount to which a rotatable axle configured for retaining strings of a stringed instrument is rotatably mounted and a stringing device configured for facilitating stringing of the stringed instrument, the stringing device being secured about the axle such that the stringing device is rotationally fixed relative to the axle, the stringing device comprising:

i. an elongate article having an inner surface and an outer surface, the inner surface and the outer surface running lengthwise from a proximal end to a distal end of the elongate article, the inner surface comprising a portion configured for mating with an axle of a rotatable axle vibrato, the inner surface further comprising a first elongate end and a second elongate end, wherein the portion configured for mating with an axle of a rotatable axle vibrato is disposed between the first elongate end and the second elongate end; and ii. a plurality of spaced-apart string passages, each string passage comprising an opening on the outer surface, the opening leading to a channel within the stringing device, the channel leading to an aperture disposed on the inner surface, each string passage being configured for facilitating the passage of an instrument string from the outer surface, through the stringing device and exiting from the inner surface, so as to facilitate wrapping of the string around part of a circumference of an axle of a rotatable axle vibrato, the method comprising:

a. placing a top end of an instrument string through an opening of a corresponding string passage, the opening comprising an eyelet seat configured for retaining an eyelet of the instrument string;

b. displacing the instrument string through the string passage, from the outer surface, through the stringing device and exiting from the inner surface, until an eyelet of the instrument string is retained in the eyelet seat, wherein the instrument string is wrapped about a portion of a circumference of the axle; and c. winding the top end of the instrument string around a tuning peg provided on a headstock of the instrument to manipulate string tension and provide a desired string pitch.

21. The method of claim 20, wherein the axle comprises a plurality of axle pins extending radially from the axle, the axle pins mating with corresponding linearly arranged mating bores along the inner surface of the stringing device in a press fit or snap fit relationship, to secure the stringing device to the axle.

* * * * *